United States Patent [19]

Hewlett, Jr.

[11] Patent Number: 4,683,818

[45] Date of Patent: Aug. 4, 1987

[54] PRINT ELEMENT CONTROL

[75] Inventor: Clarence W. Hewlett, Jr., Waynesboro, Va.

[73] Assignee: Genicom Corporation, Del.

[21] Appl. No.: 843,832

[22] Filed: Mar. 26, 1986

Related U.S. Application Data

[63] Continuation of Ser. No. 675,176, Oct. 25, 1984, abandoned.

[51] Int. Cl.[4] ..... B41J 3/12

[52] U.S. Cl. ..... 101/93.04; 101/93.09; 400/121; 400/322

[58] Field of Search ..... 400/121, 124, 303, 322, 400/120; 101/93.04, 93.05, 93.09; 346/1.1, 76 PH

[56] References Cited

U.S. PATENT DOCUMENTS

| | | | |
|---|---|---|---|
| 4,049,997 | 9/1977 | McGhee | 318/128 |
| 4,090,206 | 5/1978 | Pfeifer | 346/1.1 X |
| 4,116,567 | 9/1978 | San Pietro | 101/93.05 X |
| 4,204,777 | 5/1980 | Jen | 101/93.05 X |
| 4,213,714 | 7/1980 | Jones et al. | 400/306 X |
| 4,284,001 | 8/1981 | Leontiades | 101/93.05 |
| 4,330,142 | 11/1981 | Kos | 400/120 X |
| 4,415,286 | 11/1983 | Jennings | 400/121 X |
| 4,461,984 | 7/1984 | Whitaker et al. | 400/903 X |
| 4,480,541 | 11/1984 | Grummett | 101/93.09 X |
| 4,507,002 | 3/1985 | Matsumoto et al. | 101/93.09 X |

OTHER PUBLICATIONS

*Hewlett-Packard Journal*, by E. M. Baily et al., Nov. 1978, pp. 23–31.

*Primary Examiner*—Paul T. Sewell

*Attorney, Agent, or Firm*—Nixon & Vanderhye

[57] ABSTRACT

A control for a dot matrix shuttle printer executing a sinusoidal velocity traversal across a line on a print medium comprises calculating the instantaneous position locations of the print elements during such traversal by making use of a lookup table. A dot image buffer stores information signals representing an entire line of desired dots to be printed. The calculated positions location information and the information signals are used to cause the desired dots to be printed in spatial sequence across a dot line at desired locations at the appropriate time during shuttle motion.

11 Claims, 8 Drawing Figures

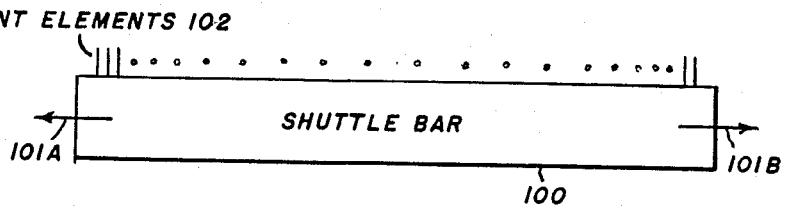
FIG.1A.
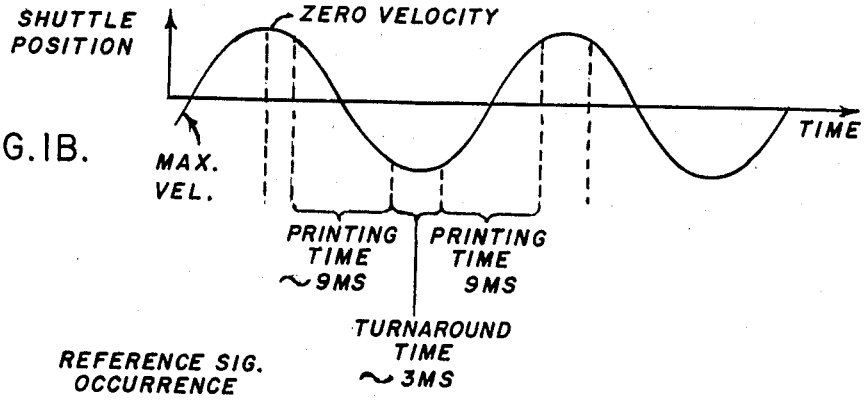
FIG.1B.
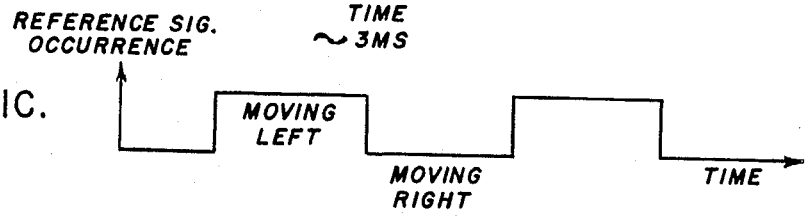
FIG.1C.
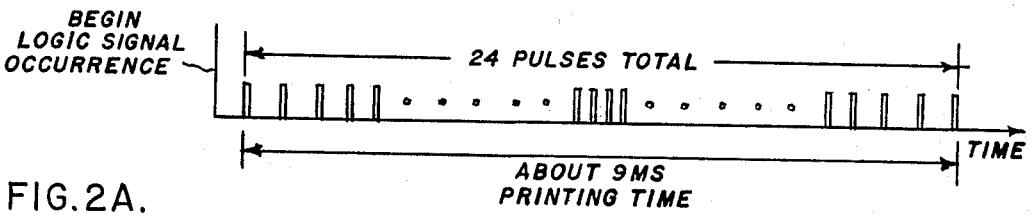
FIG.2A.
a. IRREGULAR SPACING OF BEGIN PULSES IS TO COMPENSATE FOR NON-LINEAR (SINUSOIDAL MOTION OF SHUTTLE)
b. ABOVE PICTURE WOULD ALSO BE CORRECT FOR CKLA (CLOCK THE LATCH) SIGNAL
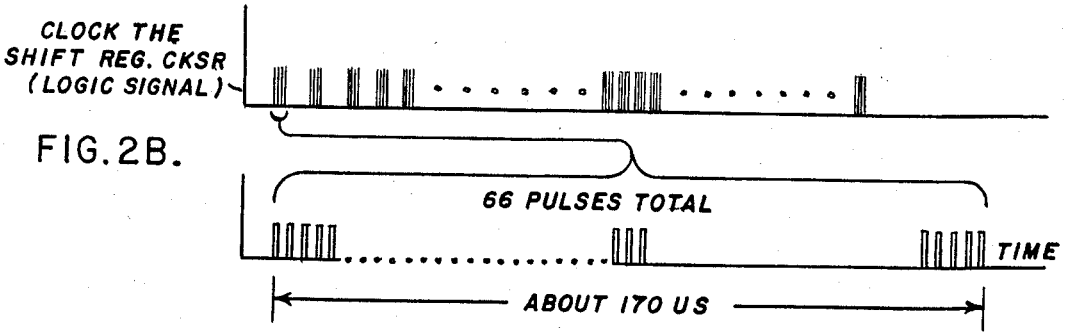
FIG.2B.
FIG.2C.
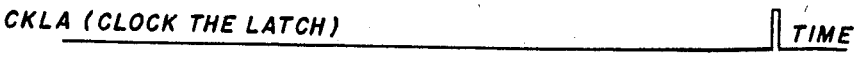

PRINT ELEMENT CONTROL

This is a continuation of application Ser. No. 675,176 filed Oct. 25, 1984, now abandoned.

BACKGROUND OF THE INVENTION

This invention is generally directed to a print element control for causing dots to be selectively printed across a line of print on a print medium as the print elements execute a traversal across the line of print. It is more particularly directed to selectively actuating desired print elements of a shuttle printer having a plurality of such print elements each of which are caused to traverse a plurality of respective dot columns along a single dot row at a sinusoidal velocity.

Shuttle dot matrix type apparatus is already known in the art. For example, a related commonly assigned copending application to Caulier Ser. No. 438,928, filed Nov. 3, 1982, now abandoned as well as commonly assigned copending application to Miller Ser. No. 531,648 filed Sept. 13, 1983, now U.S. Pat. No. 4,637,307 describes a balanced print head drive mechanism for operating a shuttle printer at a sinusoidal velocity. The contents of these earlier related applications are hereby expressly incorporated by reference.

Certain of such shuttle printers use a velocity sensor and contemplate driving the system at the natural, mechanical, resonant frequency of the shuttle printer. Serious challenges are posed under such circumstances for precisely controlling the actuation of individual printing elements moving across a line of print during shuttling action, particularly when the shuttling action is non-constant. If the control is not precise, damage to component parts as well as smearing and unacceptable printing and deterioration of the components takes place.

DESCRIPTION OF THE INVENTION

It is an object of this invention to provide an improved print element control for use in printers employing the shuttling or reciprocation of print elements or wires.

Another object of this invention is to provide an actuation system which can accommodate graphics as well as characters, and also characters in any font or width.

Another object of this invention is to meter out control signals for sequentially energizing individual print actuators as the actuators are shuttled across a line of print at a non-uniform velocity.

Briefly, in accordance with one embodiment of this invention, a print assembly control for a dot matrix shuttle printer executing a sinusoidal velocity traversal across a line of print on a print medium comprises means responsive to the zero velocity crossings of the shuttle motion for providing a reference signal. Means are also provided to respond to the reference signal for calculating the instantaneous position locations of the print elements during such sinusoidal velocity traversal by making use of a lookup table and calculations to provide the necessary position or begin signals. A dot image buffer is provided for storing information signals representing an entire line or row of desired dots to be printed. Means are then provided to respond to the position signals and the information signals for causing the desired dots to be printed in spatial sequence across a dot line at desired locations at the appropriate time during shuttle motion.

These as well as other objects and advantages of this invention will be better understood by reference to the following detailed description of the presently preferred exemplary embodiment of this invention taken in conjunction with the accompanying drawings in which:

DESCRIPTION OF THE DRAWINGS

FIG. 1A illustrates schematically an embodiment of a shuttle bar employing a plurality of print elements, where each element is shuttled to cover a plurality, as for example, 24 possible dot locations across a dot row;

FIG. 1B illustrates graphically the motion of the shuttle bar in a shuttle printer with time, and the positions in the shuttle action where the printing is to take place;

FIG. 1C illustrates the generation of reference signals in response to the zero velocity crossing information for providing signals indicating the direction of shuttling, namely moving left or moving right;

FIG. 2A illustrates graphically the generation of 24 begin signals representing the 24 dot column locations available for purposes of printing by a print wire during the traversals of the shuttle bar;

FIG. 2B illustrates graphically the fact that many clock the shift register pulses or timing signals need to be generated for each of the 24 column locations of a given row associated with each of the 66 print wires which are located on the shuttle bar. Each such begin pulse has to initiate 66 clock the shift register pulses where these individual equally spaced clock pulses are used to clock data in a serial data stream.

FIG. 2C shows graphically the fact that corresponding to the very last clock the shift register pulse of FIG. 2B, there is provided a clock the latch pulse to control the transmission of dot information to circuitry used in simultaneously firing all the selected print wires.

DESCRIPTION OF A PREFERRED EMBODIMENT

Figure 3:
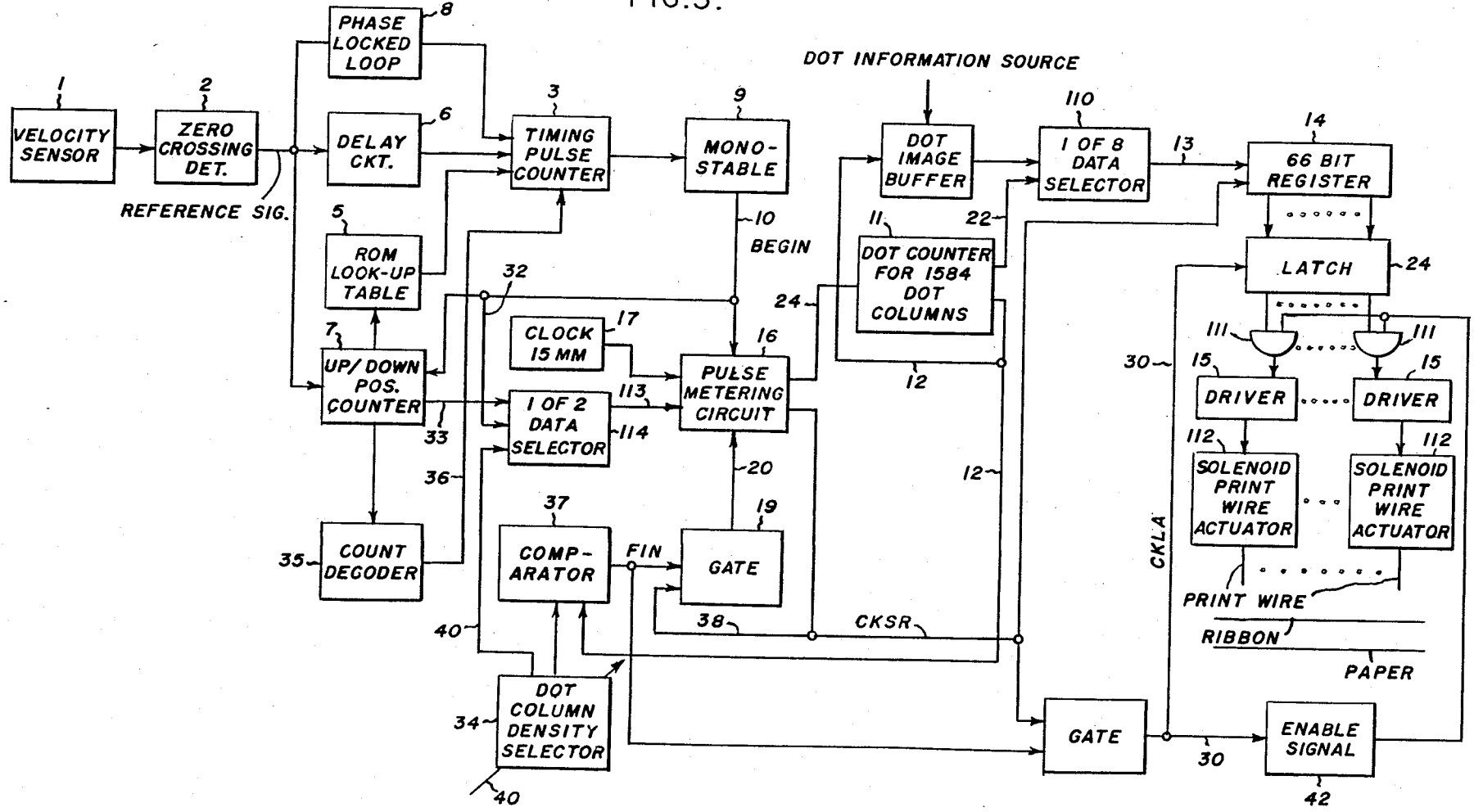
FIG. 3 illustrates one embodiment of a system for sequentially actuating a plurality of print wire or elements being shuttled at a non-constant velocity.
Figure 4:
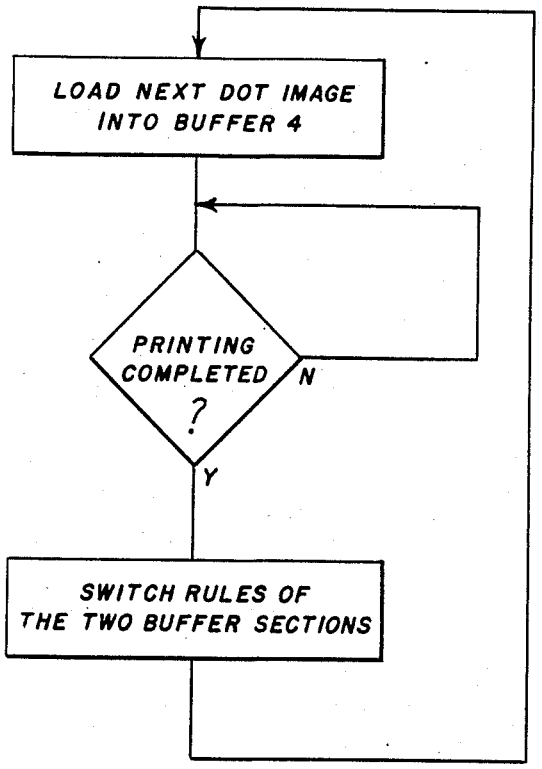
FIG. 4 is a flow diagram explaining the loading of the dot image buffer.

It may be helpful to first describe the invention in general terms. The objective is to simultaneously fire selective ones of the 66 print actuators, i.e., 66 solenoids which drive the associated print wires toward the record medium.

In one embodiment, a row of 66 print wires spaced apart 0.2 inch horizontally are to be operated to effect printing at 600 lines per minute by actuating desired ones of the print wires simultaneously at each of 24 possible dot column locations of a given row associated with each print wire as each of the print wires is shuttled across a record medium, such as paper. In one embodiment, the amplitude of shuttle motion is slightly greater than 0.2 inch. Printing or actuation of wires takes place over the 0.2 inch shuttle motion while the balance of the shuttle motion is used for turning the shuttle around to move in the opposite direction.

At a shuttle position corresponding to desired dot column locations of a given row, the object is to simultaneously fire all selected print actuators where printing of a dot is desired. To achieve this, a dot pattern corresponding to a desired dot row is first assembled in a dot image buffer (4 of FIG. 3) in its logical left to right or spatial order, but without any consideration of the timing at which dots may be needed to energize a print actuator. In the case where the dot density is selected, for example, to be 120 dots per inch, this represents a dot pattern or $0.2\times120=24$ dot positions per actuator or a total of $66\times24=1584$ total dots in a dot row. That is, we need to select the dots we want and have them available at the proper moment related to changing shuttle positions. Thus, the object is to get the dots out of the image buffer in an appropriately different order, and in a timely manner.

At any one time, we have stored in the dot image buffer 4 only a single row of all of the dots corresponding to a single row of all of the indicia, such as characters to be printed across a line of type as determined by the data information furnished from a source, such as a communication line. The technology for accomplishing this using a character ROM or graphics information is well known. Reference can be made to U.S. Pat. No. 4,342,096 dated July 27, 1982 for one such example. The object is to selectively withdraw dot information from the buffer at the appropriate time as well as in the appropriate order. Thus, as a print wire shuttles across the 24 possible dot column printing positions in a line, it must be actuated at the appropriate time to effect printing at the selected dot column positions corresponding to the indicia to be recorded on the record medium. In the example cited, the first dot row to be considered for printing are 1, 25, 49, etc., i.e., corresponding to the dot column separation of adjacent print wires. An entire row of dot information, however, is stored consecutively in the image buffer in the left to right spatial order. We, therefore, need to address the corresponding 1, 25, 49, etc. memory cells in the dot image buffer. By using a counter (11 of FIG. 3), we convert the dot information in the addressed cells into a serial pattern (available on 13 of FIG. 3) indicating dot, or no dot information for the selected column locations. The serial information is transmitted to a shift register 14 where it is formatted into a 66 bit parallel word for simultaneously driving the selected wires.

Thus, the system as described results first in addressing dot column locations in column 1, then 1 plus 24 or 25, then 1 plus 24 plus 24 or 49, etc. in a single row thereby to address the first of 24 successive dot column locations for each of the 66 print wires. When all of these dot column positions have been addressed in this manner, an enable signal is generated by 42 which causes all of the printing wires or elements selected to be actuated by print wire actuators to be driven toward an inked or carbon ribbon and into the paper to produce the desired dot information at the appropriate column locations. Next, we must address the dot column locations in column 2, then 2 plus 24 or the 26th column location, then 2 plus 24 plus 24 or the 50th column position, etc. Thus, the second of all dot column positions associated with each print wire are addressed before printing is to take place as previously described. Proceeding in this manner for the remaining column locations 3–24, each of the 66 print wires may be actuated to provide dot printing for each of its possible 24 column locations in a single row until all possible dot column locations have been covered.

DETAILED DESCRIPTION

Referring now to a detailed description of the drawings there is shown schematically in FIG. 1A a shuttle bar 100 capable of being reciprocated in the direction of arrows 101*a* and 101*b* and carrying a plurality of print wire or elements 102 which are each shuttled to span a plurality of dot column locations such that all possible dot columns in a dot row can be addressed for printing dots.

Referring to FIG. 1B, there is shown a graphical representation of shuttle position with time. The instants at the extremes of the shuttle position, that is right or left position, are defined as zero velocity crossing points as indicated on the graph. The maximum velocity is at the zero position crossings. It should be noted that not the entire sinusoidal path of the shuttle bar is utilized for printing; only the portion indicated on the graph. The turn-around time shown on the graph corresponds to the reversal of the shuttle motion from right to left or left to right.

FIG. 1C shows that by detecting the zero crossings of the velocity, a reference signal can be derived which indicates when the shuttle bar is moving left and when it is moving right.

FIGS. 2A–2C are useful in explaining the kinds of print element actuating signals that need to be derived. It should noted that the spacing of the print element actuation signals is irregular, corresponding to the non-uniformity of the shuttle bar motion across a line of print on a print medium. Thus, the first several pulse actuating signals are fairly spread out in time whereas, at maximum velocity, they are fairly close together and then they proceed to become farther spaced apart as we approach the end of travel of the shuttle bar.

In a particular embodiment involving the use of 66 printing elements, for each reference signal shown in FIG. 1C, 24 begin signals have to be developed as shown in FIG. 2A. For each begin signal shown in FIG. 2A, 66 clock the shift register pulses have to be generated as shown in FIG. 2B. These correspond to the individual dots that we gather for each of the 66 print elements. It should be noted that whereas the begin signals have a variable spacing corresponding to the sinusoidal velocity of the shuttle bar for each dot column position, for each of the clock the shift register pulses the spacing is equal providing the transmission of the serial dot stream in a sufficiently short time before the next print wire actuation cycle occurs.

Thus, for each begin signal we can print or not print selectively depending upon whether a dot is to be located at that position or not, where the positions represent the instantaneous dot column locations of the 66 printing elements. Thus, one of the major objectives of this invention is to provide an arrangement to provide print element actuation signals in a situation where there is non-uniform or sinusoidal movement of the shuttle bar and where the shuttle bar carries a plurality of spaced printing elements spanning a print line or row across a print medium, such as paper.

Referring to FIG. 3 there is shown a velocity sensor 1 which is located at one end of the shuttle bar in a particular embodiment and provides information on the instantaneous velocity of the shuttle bar which in the particular application is sinusoidal. For details on how a shuttle printer operating with sinusoidal velocity is achieved, reference can be made to the aforementioned copending applications. The zero crossing detector 2 senses the zero velocity occurrences of the shuttle bar during its right and left movements across a print line. The zero crossing detector output mentioned earlier generates the reference signal shown in FIG. 1C which indicates when printing is to commence in moving in one direction and then terminate, and then when printing is to commence and terminate in the other direction. In order to generate the begin pulses which correspond to the instantaneous position of the printing elements as they move across a print line, each transition of the reference signal identifies essentially the commencement of a printing cycle to take place. The timing pulse counter 3 serves to produce begin pulses occurring at the spatial locations where printing may or may not take place depending upon the dot information that is available from a dot image buffer 4 which will be described shortly. The timing of the begin pulses available from counter 3 depends on the information supplied from the ROM lookup table 5. As indicated earlier, since the traversal of the shuttle bar is sinusoidal, the pulse occurrences of the begin pulses from 3 are not equally spaced as shown in FIG. 2A, but correspond to the sinusoidal movement of the shuttle bar. The reference signal available from 2 is applied to a delay circuit 6 which introduces a delay, for example of the order of 1 millisecond, which results in initiating printing a brief period of time after the zero velocity crossing is reached and corresponds to what is referred to as a turn-around time in FIG. 1B. The reference signals are also applied to the position counter 7. To provide a higher frequency clock for subdividing the interval between transitions of the reference signal, phase locked loop 8 responds to the reference signal available from 2 to produce clock pulses at a fixed multiple of 4,096 times the rate of the reference signal. The timing pulse counter 3 responds to a number of clock pulses available from 8 after the delay period established by 6 has expired depending upon the information available from the lookup table 5 to produce a timing interval for the next begin pulse as shown in FIG. 2A. Monostable circuit 9 is provided to establish the duration of each begin pulse which is initiated by the output of counter 3. Each begin pulse available on lead 10 is then used to increment or decrement (depending on moving right or left) the position counter 7 and thereby enable the lookup table 5 to provide the next interval for the timing pulse counter to generate the succeeding begin pulse. In a particular embodiment depending on the number of print wires and the rate of shuttling, the begin pulses available on 10 occurred in batches of 24 for each shuttle traversal or swing. Obviously, this figure will vary depending on the shuttle speed and the number of print wires that may be involved. Thus, the begin signals available on 10 correspond to or represent the start-up of a dot gathering process which will involve gathering one dot for each of the 66 print wires which are being shuttled across a line of print.

Briefly speaking, in one embodiment, the dot image buffer 4 comprised two sections. During one period of operation the first section was being filled with dot row information available from a data source as shown in the flow diagram 4 under control of a microprocessor which is included in the dot information source. The second section was being unloaded and processed to control printing as described in FIG. 3. When the loading process is completed and the unloading process is finished at the end of printing time as shown in FIG. 1B, which occurs before the turn around time is finished, the roles of sections one and two of buffer 4 are interchanged under software control. The advantage is that the two functions of loading and unloading can take place simultaneously in a timely manner.

The dot gathering process is controlled by the dot counter 11 coupled to dot image buffer 4 and 1-of-8 data selector 110. In one embodiment the dot image buffer was selected to be a 2K by 8 static RAM in which the memory cells are organized into bytes of 8 bits each with a total available capacity of 16384 bits. Since in our one embodiment, a dot line was selected to be 1584 dots long, it is necessary for the dot counter 11 to select the particular byte location to be addressed as well as the particular bit location. A typical such RAM is type number TMM2016AP-90 available from Toshiba America Inc. The dot counter 11 furnishes a plurality (in the one embodiment eight address lines for addressing one of about two hundred bytes) of address lines to the dot image buffer 4 for selecting a single byte of information, and it also furnishes 3 lines to the 1-of-8 data selector 110 to select a single bit from such selected byte. These selected bits then are available over lead 13 in serial form for storage in register 14 where they are then made available in parallel form for energizing the driver 15 through circuitry to be described. It is sufficient to say at this time that an enable signal for each print wire is generated once per completion of a dot gathering process for the 66 print wires, or 24 enable signals for each shuttle swing. Thus, the dot counter 11 addresses each byte of information stored in dot image buffer 4 by signals supplied over lead 12. Within each byte a selection then must be made of the bit which is to be addressed. This is accomplished by signals supplied from the dot counter 11 over lead 22. Thus, the output of the 1-of-8 data selector corresponds to a bit signal associated with a particular print wire at a particular column location. All of the signals serially available on lead 13 then represent the dot or no dot image information stored in dot image buffer 4 for the particular 1 of 24 column locations in a single row being considered for each print wire. The output of register 14 is the same information supplied in parallel to latch 24. After the latch has been loaded, a signal available on lead 30 clocks the latch to load the shift register 14 into latch 24 and initiates an enable signal in 42 which controls the duration of time during which the driver circuits may be activated by AND gates 111. This is used to protect and provide an appropriate energization of the respective drivers 15 associated with each solenoid print actuator wire 112.

In a particular embodiment, a begin pulse from monostable 9 causes the pulse metering circuit 16 to supply pulses over lead 24 to the dot counter 11 at the clock rate available from a clock 17. As previously mentioned, the dot counter 11 then supplies the plurality of addresses to the dot image buffer 4 for selecting the first, twenty-fifth, forty-ninth, etc., dot column locations and the signals available over lead 22 select a bit from the particular byte available from buffer 4 as addressed by dot counter 11. After the first dot gathering process has been completed for the first of 24 dot column locations in a single row associated with each of the 66 print wires, the dot gathering process has to begin at a time corresponding to the next or second dot column locations. This is accomplished in the following manner. The begin pulses available on 10 are applied over lead 32 to the position counter 7 which is incremented or decremented now to the second dot column location. The incremented or decremented output from 7 is supplied over lead 33, data selector 114 and lead 113 under control of begin pulses from monostable 9 to the pulse metering circuit 16 so that the pulse metering circuit will furnish clock pulses from 17 at the next or second column location for the first print wire and then in succession the dot counter will supply over lead 12 the signal for the 26 and the 50th location, etc. After the signal supplied over lead 33 to the pulse metering circuit via lead 113 and 1-of-2 data selector 114 has caused the pulse metering circuit 16 to supply 1 pulse to the dot counter 11 so that it is pointing to the second dot, then the path 33 is disabled by the termination of the begin pulse applied thereto and dot column density selector 34 now supplies a signal over lead 40 to circuit 16 to cause the metering of 24 pulses so that the 26th dot is reached. And this process under control of selector 34 is repeated until this dot gathering process is completed. Thus, the position counter 7 is incremented by a count of one for each begin pulse on lead 10. This means that the signals available on 33 then occur at the successive column locations associated with the movement of each print wire. The signals available from the dot column density selector 34 provide the 24 pulses which correspond to the column spacing between the print wires so that first one print wire, then the second, then the third print wire, etc., are addressed. This process continues until all of the column positions associated with print wire movement across a print line on a print medium have been taken care of. At this time count decoder 35 responds to the 24th begin pulse as defined by the count in position counter 7 to supply a signal over lead 36 to block further activity in the timing pulse counter 3. Thus, the signal on 36 occurs once for every 24 begin pulses. To complete the dot gathering process for each of the 66 print wires in a particular column location, a comparator 37 is provided. The comparator responds to the count output of dot counter 11 on lead 12 and the signal available from the density selector 34 which represents the count 66 to produce an output or FIN signal indicating that all of the print wires have been addressed for a given dot column position within the available 24 column positions. The output signal is applied to gate 19. The gate 19 responds to a signal available on lead 38 occurring once for every 24 pulses available from the metering circuit 16 and the FIN signal available from comparator 37 to supply a signal over 20 blocking further metering by pulse metering circuit 16 until the next begin pulse is received.

Although one exemplary embodiment of this invention has been described in detail above, those skilled in the art will appreciate that there are many possible variations and modifications which may be made in the exemplary embodiment while retaining many features and advantages of the invention. For example, while the density selector 34 was shown to provide output pulses for every 24 dot columns depending upon the number of print wires on the shuttle bar and the number of columns addressed, the density selector can provide a different number of pulses under the control of the operator as shown by the arrow 41. The important feature is that the present invention meters out control signals for sequentially energizing individual print wires depending on any number that is selected which occurs in a plurality of banks of actuators which number of banks again can be selected by the operator as the actuators are shuttled across a line of print at a non-uniform velocity. Accordingly, all such modifications and variations are intended to be included within the scope of the following claims.

What I claim as new and desire to secure by Letters Patent of the United States is:

1. A printing element control for causing dots to be selectively printed across a line of print on a print medium as a line of spaced-apart print elements execute a traversal across said line of print to print at least a major segment of only a single row of dots associated with said print elements, said print elements being spaced apart by n dot column position, said control comprising:

means for providing control signals which correspond to traversal positions of said print elements;

a dot line image data buffer means for storing in a consecutive address order all of the dot printing signals representing at least a major segment of a single dot line image to be printed, by said print elements, said segment spanning at least a plurality of the distances between said spaced-apart print elements wherein the n dot column bit positions associated with each print element are not fixed;

means for selectively addressing the Jth dot column bit position in said dot line image buffer associated with each spaced-apart printing element, where J=1 to n, for retrieving dot printing signals in corresponding dot column bit positions for each printing element, and means responsive to said control signals and to said retrieved printing signals for causing said line of print elements to print said single dot line image during said traversal of said print elements in spatial sequence across said line of print.

2. A control for printing elements in a dot matrix shuttle printer executing a bi-directional traversal across a line of print on a print medium, said printing elements being spaced apart by a fixed distance which corresponds to n dot column positions comprising:

means responsive to said shuttle motion for providing a reference signal;

means responsive to said reference signal for calculating the occurrence times of instantaneous spatial locations of said print elements which are spaced at equal successive distances corresponding to desired dot position locations on the print medium during such traversals to provide position signals representing said occurrence times;

a dot line image buffer for storing in a consecutive order dot printing information signals representing the dot image of an entire line of dots to be printed wherein n dot column bit positions in said dot line image buffer are associated with each print element and n is a variable integer;

means for addressing the Jth dot column bit position in said dot line image buffer associated with each spaced-apart printing element, where J 1 to n, for retrieving dot information in corresponding dot column bit positions for each printing element, and means responsive to said position signals and to said retrieved information for causing corresponding dots to be printed in spatial sequence across said line of print.

3. An arrangement according to claim 2 wherein said means for calculating comprises:

a lookup table, a position counter, a timing counter, said timing counter being responsive to said reference signals for causing said position counter to count up or down in accordance with said reference signal, said lookup table being coupled to said timing counter and responsive to the output of said position counter to determine the number of timing pulses provided by said timing counter for providing said instantaneous position location information.

4. An arrangement according to claim 2 further comprising:

a dot counter for producing a succession of dot count signals, one for each print element;

each instantaneous location information signal being associated with a predetermined dot printing column along a dot printing line;

means responsive to the retrieved output of said dot line image buffer and to said dot counter for actuating selected print elements for causing desired dots to be printed in spatial sequence across said dot line in accordance with the dot image printing information stored in said dot line image buffer.

5. An arrangement according to claim 4 further including a dot counter for producing a succession of dot count signals, one for each print element, and further comprising means for varying the dot column density including:

a source of dot column density information, a comparator for comparing the count existing in the dot counter with the output of said source of dot column density information to produce an output signal upon reaching a predetermined comparison, a pulse metering circuit, said dot counter being coupled to said pulse metering circuit and being responsive to said instantaneous location information and to said output signal for varying the dot column density.

6. A control for print elements in a dot matrix printer executing a traversal across a line of print on a print medium, said printing elements being spaced apart by n dot column positions comprising:

means for providing a reference signal representing a predetermined position of the print element;

means responsive to said reference signal for calculating timing signals required to obtain equally spaced apart position locations of said print elements during such traversals;

a dot line image buffer for storing in a consecutive order dot printing information signals representing the spatial locations of at least one entire dot line of dots to be printed wherein n dot column bit positions in said dot line image buffer are associated with each print element and n is a variable integer;

means for addressing the Jth dot column bit position in said dot line image buffer associated with each spaced-apart printing element, where $J=1$ to n, for retrieving dot information signals in corresponding dot column bit positions for each printing element, and means for responsive to said timing signals and to said retrieved dot printing information signals for causing dots to be printed in spatial sequence across said line of print.

7. An arrangement according to claim 6 wherein:

said printer executes non-constant velocity traversals across said line of print, and said means for calculating comprises means for calculating such timing signals associated with such non-constant velocity traversals.

8. An arrangement according to claim 6 wherein said printer comprises:

a shuttle printer executing a bi-directional traversal of a plurality of spaced-apart print elements, each element successively spatially addressing a plurality of dot columns during such traversals, and means for selecting only those dot printing information signals stored in said dot line image buffer representing dots to be printed at the dot column locations then being spatially addressed by such print elements.

9. A control for regularly spaced-apart print elements in a dot matrix printer executing repeated bi-directional non-linear traversals across a line of print on a print medium, said printing elements being spaced-apart by n dot column positions, said control comprising:

means for providing a reference signal representing the time occurrence of a predetermined position of said print element;

means responsive to said reference signal for calculating regularly spaced-apart position locations of said print elements during such non-linear traversals to provide corresponding position signals;

a dot line image buffer for storing in a consecutive order information signals representing the spatial image of dots to be printed along a complete line of print, wherein a plurality of lines of printed dots depict a row of characters, wherein n dot column bit positions in said dot line image buffer are associated with each printing element and n is a variable integer.

means for addressing the Jth dot column bit position in said dot line image buffer associated with each spaced-apart printing element, where $J=1$ to n, for retrieving information signals in corresponding dot column bit positions for each printing element, and means responsive to said position locations and to said extracted information signals for selectively causing said print elements to print said desire dots line-by-line in spatial sequence on said record medium.

10. A shuttle printer for printing indicia in the form of dots located at selected column and row locations on a record medium comprising:

a shuttle print mechanism having regularly spaced-apart dot print elements and a back-and-forth shuttling movement, said printing elements being spaced-apart by n dot column positions;

means responsive to the movement of said shuttle print mechanism for producing a reference signal representative of the position of said print mechanism.

a dot line image buffer for storing in a consecutive order a binary data pattern corresponding only to a dot row to be printed in a sequential spatial order without further regard for the indicia associated with the binary data to be printed in such dot row and without any consideration of the timing at which print elements are to be actuated to effect printing of dots, wherein n dot column positions in said dot line image buffer are associated with each print element and n is a non-fixed integer;

means for addressing the Jth dot column bit position in said dot line image buffer associated with each spaced-apart printing element, where $J=1$ to n, for retrieving binary data in corresponding dot column bit positions for each printing element, and said addressing means further including means using said reference signal for selectively withdrawing said binary data from said buffer at the appropriate time as well as in the appropriate order to effect printing of said indicia.

11. A printing element control for causing dots to be selectively printed across a line of print on a print medium as spaced-apart print elements execute a traversal across said line of print to print at least a major segment of a single row of dots, and print elements being spaced-apart by n dot column positions, said control comprising:

means for providing control signals which correspond to traversal positions of said print elements;

a dot line image data buffer means for storing in a consecutive order dot printing signals representing at least a major segment of a single dot line image to be printed by said print elements, said segment spanning at least a plurality of the distances between said spaced-apart print elements, wherein n dot column bit positions in said dot line image data buffer are associated with each print element and n is a non-fixed integer;

means for addressing each of the bytes in said dot line image buffer, said means for addressing further including means for selecting a data bit from each of said addressed bytes, whereby corresponding dot column bit positions are selected for each printing element, and means responsive to said control signals and to said retrieved printing signals for causing said dot image to be printed as a major segment of a single dot line during said traversal of said print elements in spatial sequence across said line of print.

* * * * *